US012251015B2

(12) United States Patent
Allen

(10) Patent No.: US 12,251,015 B2
(45) Date of Patent: Mar. 18, 2025

(54) CHAIR AND TABLE FURNITURE SYSTEM WITH COMPACT STOWAGE CONFIGURATION

(71) Applicant: Wendy Hanson Allen, Atlanta, GA (US)

(72) Inventor: Wendy Hanson Allen, Atlanta, GA (US)

( * ) Notice: Subject to any disclaimer, the term of this patent is extended or adjusted under 35 U.S.C. 154(b) by 128 days.

(21) Appl. No.: 18/105,688

(22) Filed: Feb. 3, 2023

(65) Prior Publication Data

US 2024/0260749 A1 Aug. 8, 2024

(51) Int. Cl.
*A47C 3/16* (2006.01)
*A47B 13/02* (2006.01)
*A47B 83/02* (2006.01)

(52) U.S. Cl.
CPC ..... *A47B 83/0213* (2017.08); *A47B 13/023* (2013.01); *A47C 3/16* (2013.01)

(58) Field of Classification Search
CPC ..... A47C 3/16; A47B 83/021; A47B 83/0213
USPC ..... 297/1, 2, 3, 118, 119, 140, 141, 158.5, 297/171.5, 271.6, 440.1, 440.14
See application file for complete search history.

(56) References Cited

U.S. PATENT DOCUMENTS 433,623 A * 8/1890 Hunzinger ..... A47B 83/02 297/140
475,505 A * 5/1892 Hunzinger ..... A47B 83/045 297/140
1,326,415 A * 12/1919 Negus ..... A47D 1/04 297/1
1,660,119 A * 2/1928 Decker ..... A47C 13/00 297/140 X
1,961,457 A * 6/1934 Schnelder ..... A47B 85/04 297/121
2,030,195 A * 2/1936 Breese ..... A47B 7/02 297/140 X
2,145,201 A * 1/1939 Raeuber ..... A47B 83/021 297/142
2,164,715 A * 7/1939 Krainbill ..... A47C 13/005 297/440.14 X
D143,454 S * 1/1946 White ..... D6/692.6
D144,404 S * 4/1946 Mabry ..... 297/3
(Continued)

FOREIGN PATENT DOCUMENTS

AT 14802 U1 * 6/2016 ..... A47B 83/02
CN 204812815 U 12/2015
(Continued)

*Primary Examiner* — Rodney B White
(74) *Attorney, Agent, or Firm* — Mitch Harris, Atty at Law, LLC; Andrew M. Harris

(57) ABSTRACT

A furniture system that provides seating and a table top that may be stowed in-place, resulting in a compact and aesthetically pleasing appearance when stowed. The furniture system includes a table with a table top and a support base that supports the top, and one or more chairs. The chairs have top seating surfaces when the chair is in a seating orientation, and have side surfaces oriented in a direction perpendicular to the top seating surface. The side surfaces define a spacing between them such that when the chair is rotated to a stowage orientation, the side surfaces form a top and bottom of the rotated chair and align with an underside of the table top and the floor to visually close a space between the underside of the table top and the floor when stowed.

22 Claims, 10 Drawing Sheets

(56) References Cited

U.S. PATENT DOCUMENTS

D144,591 S * 4/1946 Schutes ..... 297/140 X
D147,581 S * 9/1947 Coulter ..... 297/3
2,461,684 A * 2/1949 Dierickx ..... A47B 83/045 297/140 X
D154,453 S * 7/1949 Schukat ..... 297/140 X
D165,554 S * 12/1951 Schukat ..... 297/140 X
D166,006 S * 2/1952 Trumfio ..... 297/140 X
D167,404 S * 8/1952 Huth ..... 297/140 X
2,614,018 A * 10/1952 Engel ..... A47B 83/045 297/140 X
3,301,590 A * 1/1967 Young ..... A47B 83/02 297/140 X
3,353,865 A * 11/1967 Bass ..... A47B 83/00 297/140 X
3,479,083 A * 11/1969 Percival ..... A47B 3/14 297/118
3,556,586 A * 1/1971 Beardmore ..... A47D 1/08 297/118 X
3,592,506 A * 7/1971 Breslow ..... A47D 11/00 297/118 X
3,650,563 A * 3/1972 Hansson ..... A47D 1/006 297/1 X
3,822,078 A * 7/1974 Spadolini ..... A47C 5/12 297/DIG. 2
3,955,850 A * 5/1976 Toso ..... A47C 13/005 297/118
D248,516 S * 7/1978 Johansson ..... 297/1 X
4,205,876 A * 6/1980 Cetina ..... A47D 1/103 297/118
4,783,118 A * 11/1988 Ryan ..... A47D 1/04 297/3
5,415,454 A * 5/1995 Fu-Tsung ..... A47D 1/08 297/3 X
5,509,720 A * 4/1996 Croom ..... A63H 33/04 297/440.14 X
5,865,501 A * 2/1999 Eisenberg ..... A47B 83/02 297/157.1
6,045,193 A * 4/2000 Johnson ..... A47B 85/00 297/440.1
6,155,641 A * 12/2000 Frost ..... A47C 3/20 297/118 X
6,367,874 B2 * 4/2002 Casini ..... A47D 9/053 297/118 X
6,739,670 B2 * 5/2004 Johnson ..... A47B 83/02 297/135
7,322,642 B2 * 1/2008 BoJack ..... A47B 83/001 297/440.14 X
7,533,940 B1 * 5/2009 Zook ..... A47B 83/02 297/140 X
D655,519 S * 3/2012 Messenger ..... D6/337
D673,380 S * 1/2013 Lade ..... D6/336
D772,588 S * 11/2016 Kim ..... D6/337
D794,969 S * 8/2017 Leibovies ..... D6/335
D823,011 S 6/2018 Kesler
2002/0014792 A1 2/2002 Casini
2004/0201261 A1 10/2004 Johnson
2010/0207442 A1 * 8/2010 Hrib ..... A47C 13/005 297/440.14
2011/0220522 A1 * 9/2011 Shen ..... A47D 3/00 297/140 X
2011/0221240 A1 * 9/2011 Shen ..... A47D 3/00 297/140 X
2016/0095428 A1 * 4/2016 Turner ..... A47D 11/00 297/123

FOREIGN PATENT DOCUMENTS

CN 205658629 U 10/2016
DE 2719761 A1 11/1978
DE 202017105993 U1 * 11/2017 ..... A47B 39/00
GB 2417195 A 2/2006
KR 20150087003 A * 7/2015 ..... A47B 83/021
WO WO-2019140475 A1 7/2019

* cited by examiner

CHAIR AND TABLE FURNITURE SYSTEM WITH COMPACT STOWAGE CONFIGURATION

BACKGROUND

1. Field of Disclosure

The field of representative embodiments of this disclosure relates generally to furniture systems, and more particularly, to a furniture system including one or more chairs and a table that have a usage configuration and a stowage configuration in which the chairs are unobtrusively stowed beneath and conform to a bottom edge of the table top.

2. Description of the Related Art

Furniture systems including chairs and tables are available in a wide variety of forms and are used for both primary and supplemental seating. Efficient storage is sometimes provided by the use of folding chairs and folding tables, but typically require additional storage space and require both locating and retrieving the chairs and tables before they may be used.

The alternative of leaving tables and chairs in place is not generally aesthetically pleasing, and in some cases leaving the furniture in place may not be permitted, e.g., in commercial facilities such as hotels and schools. Since walkway areas are generally those between fixtures and furniture that ordinarily stays in place, walkway space can be expected to be blocked or reduced by the presence of supplemental seating. Additionally, in smaller homes, apartments and so-called "tiny houses", space is at a premium, so any space that can be gained by compacting or at least partially storing furniture is desirable.

Therefore, it would be desirable to provide a furniture system including tables and chairs that may be left in-place, while providing an unobtrusive and/or aesthetically pleasing appearance while not in-use.

SUMMARY

The objectives of providing a furniture system including tables and chairs that also provides a compact and aesthetically pleasing appearance while not in-use are achieved in a furniture system and its method of use.

The system is a furniture system that provides seating and a table top. The furniture system includes the table, which has a table top having a substantially planar top surface and a support base that supports the table top above a floor, and one or more chairs. The chairs each have a top seating surface on a top of the chair when the chair is in a seating orientation, and have side surfaces oriented in a direction perpendicular to the top seating surface. The side surfaces define a spacing between them such that when the chair is rotated to a stowage orientation, the side surfaces form a top and bottom of the rotated chair and align with an underside of the table top and the floor to visually close a space between the underside of the table top and the floor when the chairs are moved underneath the table top.

The summary above is provided for brief explanation and does not restrict the scope of the Claims. The description below sets forth example embodiments according to this disclosure. Further embodiments and implementations will be apparent to those having ordinary skill in the art. Persons having ordinary skill in the art will recognize that various equivalent techniques may be applied in lieu of, or in conjunction with, the embodiments discussed below, and all such equivalents are encompassed by the present disclosure.

DETAILED DESCRIPTION OF ILLUSTRATIVE EMBODIMENT

The present disclosure reveals furniture systems and their associated methods of operation and manufacture that provide a compact and aesthetically pleasing stowage configuration. The furniture systems include a table and one or more chairs that may be stowed beneath a bottom of the table top and that close the space beneath the bottom of the table top and the floor when the chairs are stowed. The chairs and tables are suitable for both adults and children, with appropriate size scaling, and may be molded from plastic, plaster cement, fiberglass concrete, or wood composite, machined or constructed from stone, metal or wood, or may include a frame that is covered by one or more of leather, plastic, plaster, polymers, fabric, or any other suitable material.

Figure 1:
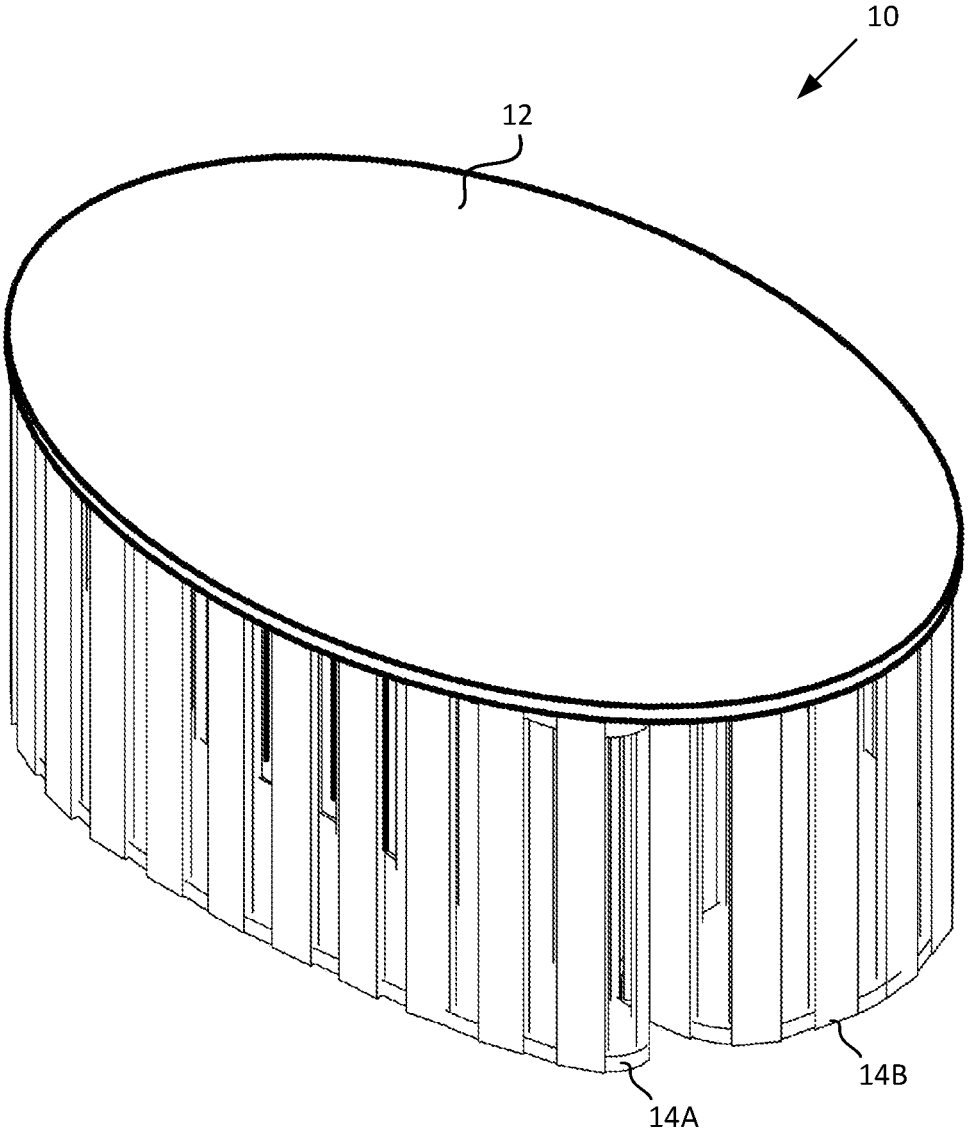
FIG. 1 is an upper right front perspective view showing an example furniture system 10 in a stowage configuration, in accordance with an embodiment of the disclosure.
Figure 2:
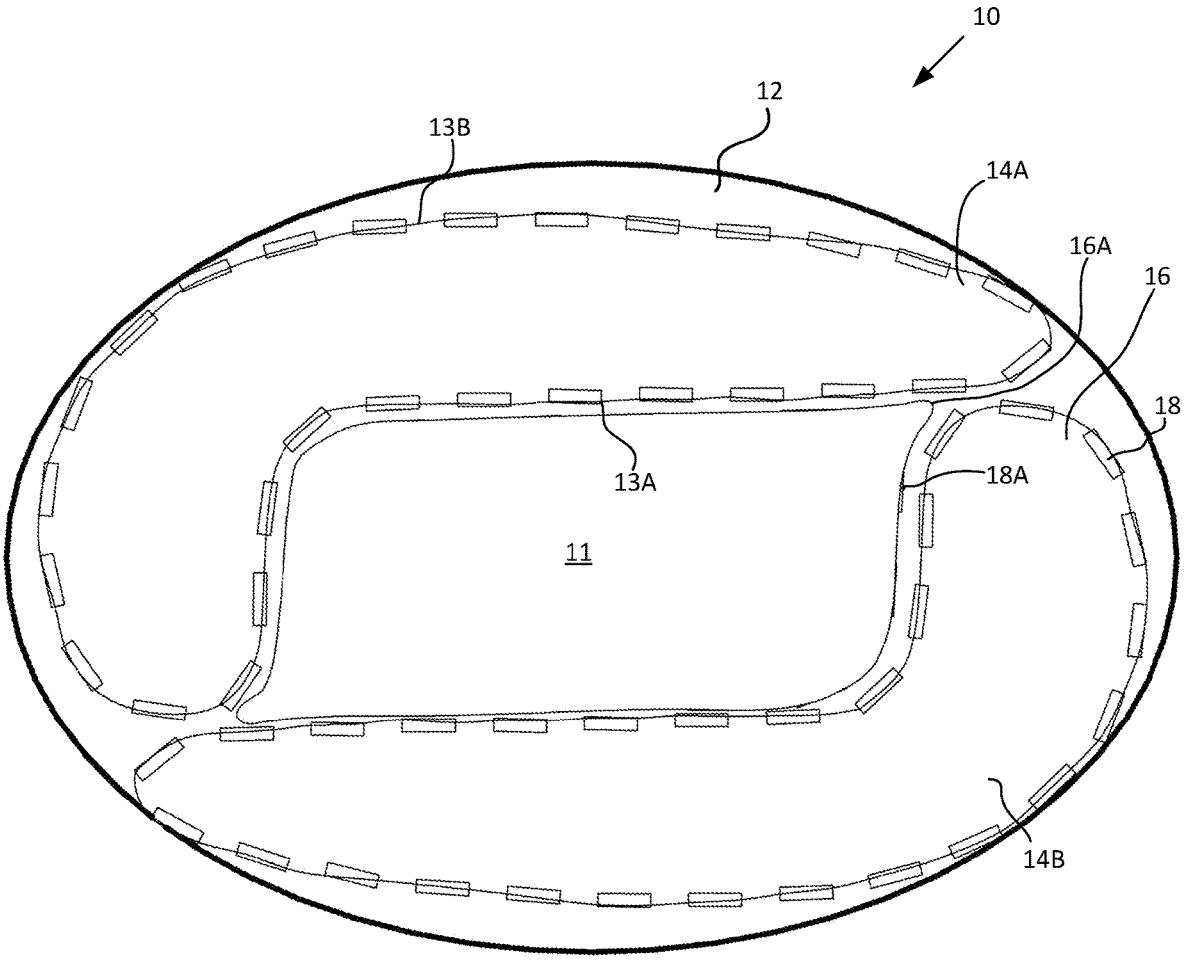
FIG. 2 is a bottom view of example furniture system 10 in the stowage configuration, in accordance with an embodiment of the disclosure.
Figure 3:
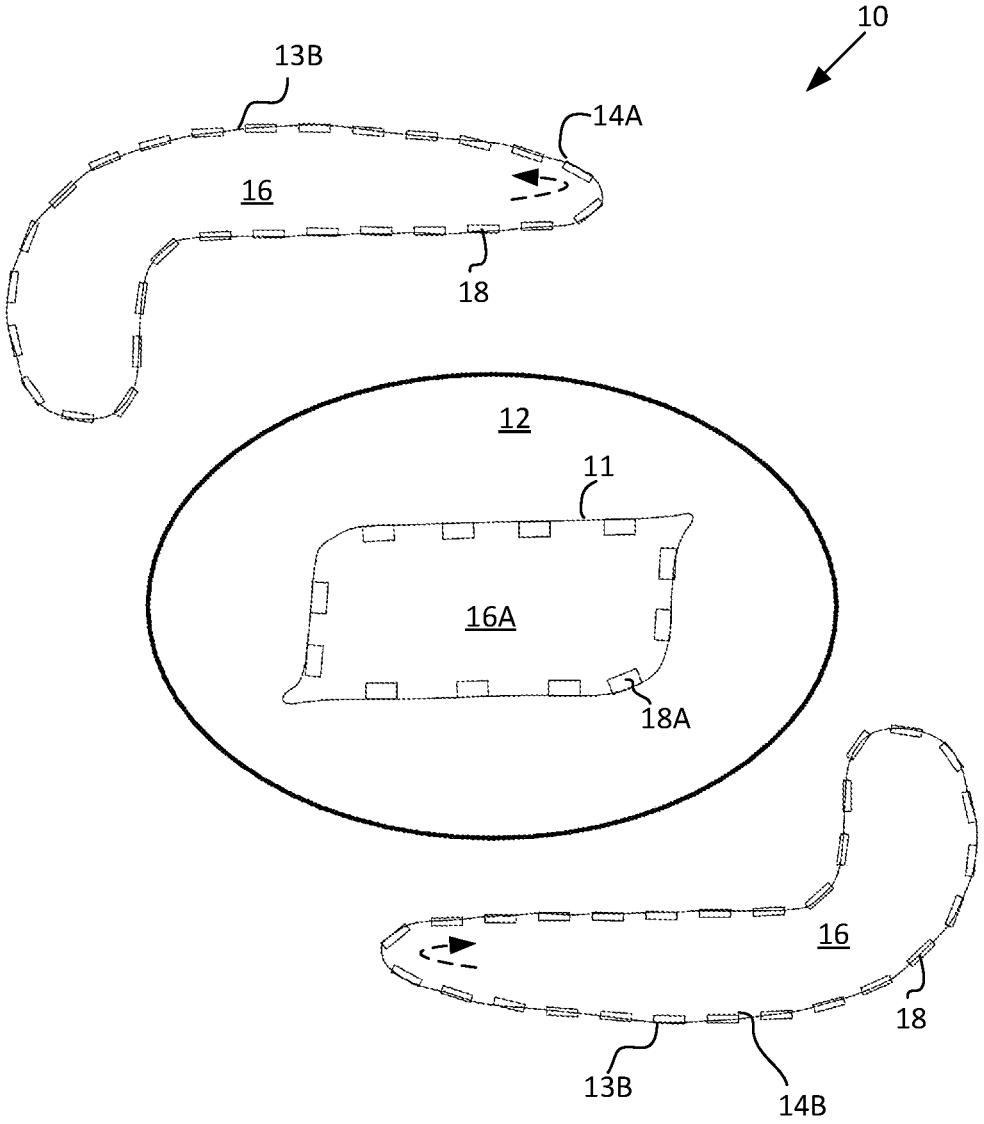
FIG. 3 is a bottom view of example furniture system 10 with chairs 14A,14B extracted in preparation for use, in accordance with an embodiment of the disclosure.
Figure 4:
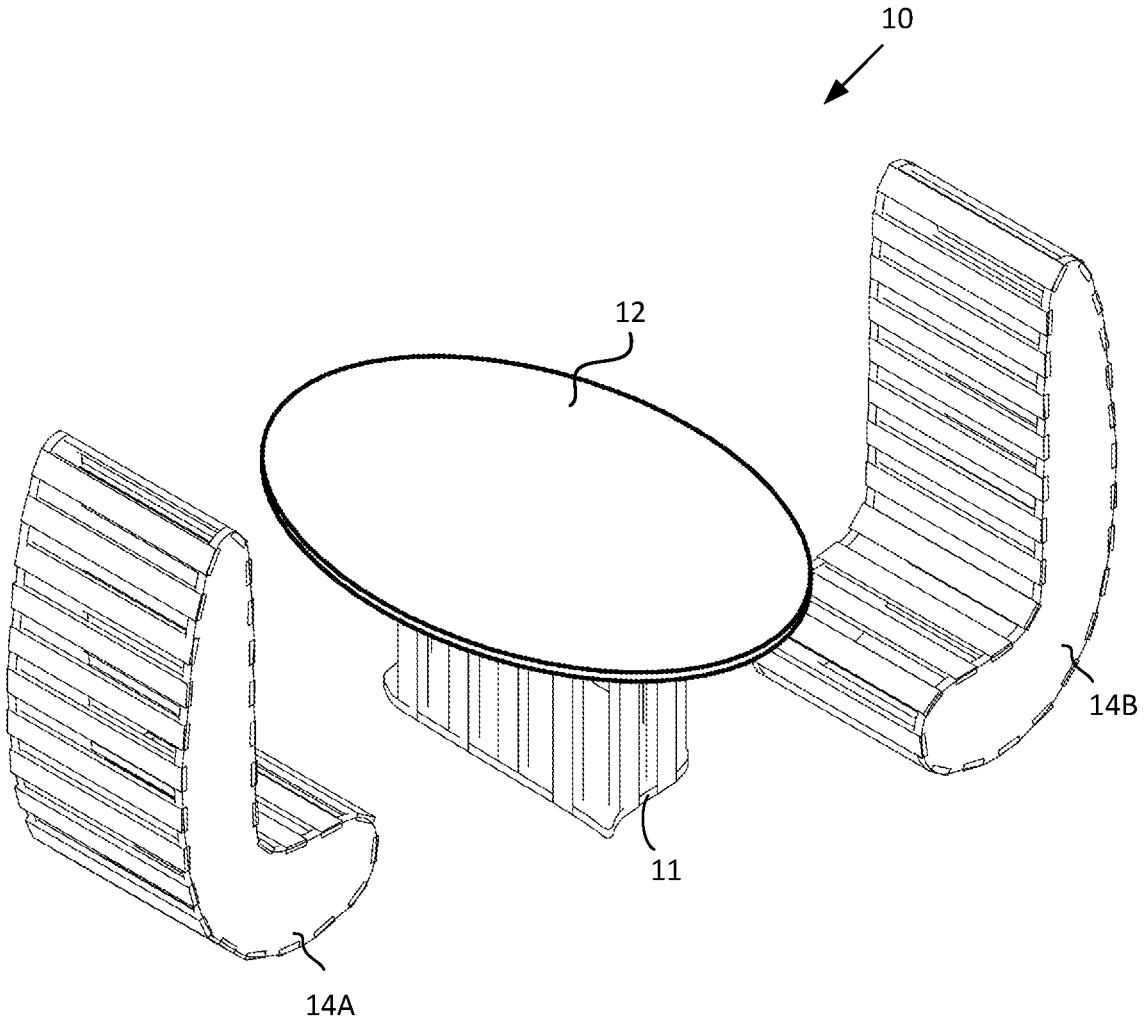
FIG. 4 is an upper right front perspective view of example furniture system 10, in an in-use configuration, in accordance with an embodiment of the disclosure.

Referring now to FIG. 1, a upper right front perspective view of an example furniture system 10 is shown in a stowage configuration, in accordance with an embodiment of the disclosure. A pair of chairs 14A, 14B are inserted beneath a planar table top 12 of uniform thickness, to provide the appearance of a unitary table assembly. Referring to FIG. 2, a bottom view of example furniture system 10 is shown in the stowage configuration, in accordance with an embodiment of the disclosure. Chairs 14A, 14B are shaped to provide a curved top seating surface 13A and a curved bottom/back surface 13B, referenced to the orientation of chairs 14A, 14B, when they are in an in-use configuration. In the depicted example, chairs 14A, 14B are in their stowage configuration, so top seating surface 13A faces inward toward an outer surface of a table base 11, which is contoured to both stop and align chairs 14A, 14B, as they are inserted to their stowage positions. In the stowage configuration, as seen in FIG. 1, chairs 14A, 14B close the gap between a bottom outer edge of planar table top 12 and the floor and the elliptical curvature of table top 12 approximates the outer edge of curved bottom/back surface 13B of chairs 14A, 14B, so that the resulting visual appearance is that of a unitary furniture item, e.g., a cabinet or credenza having an elliptical top/bottom profile. In the illustrated example, chairs 14A, 14B are fabricated from two side panels 16 that are connected together with a plurality of slats 18, which provides a structure that may be fabricated out of wood and used as-is, or that may be padded and covered with other upholstery materials, such as cloth or plastic fabrics. Similar construction is provided in example furniture system 10 for table base 11. A bottom panel 16A is connected to a table top support panel of identical construction (not shown), by a plurality of slats 18A. Referring now to FIG. 3, a bottom view of example furniture system 10 with chairs 14A,14B extracted in preparation for use is shown, in accordance with an embodiment of the disclosure. After chairs 14A,14B are extracted from underneath table top 12, e.g., by pulling on them to slide them along the floor, chairs 14A,14B are rotated, e.g., by lifting one side of chairs 14A,14B, as indicated by the dashed arrows, to place a bottom end of curved bottom/back surface 13B on the floor, with a top end of curved bottom/back surface 13B extending upward to, for example, form a seating/table arrangement as shown in FIG. 4. FIG. 4 is an upper right front perspective view of example furniture system 10, in an in-use configuration, in accordance with an embodiment of the disclosure.

Figure 5:
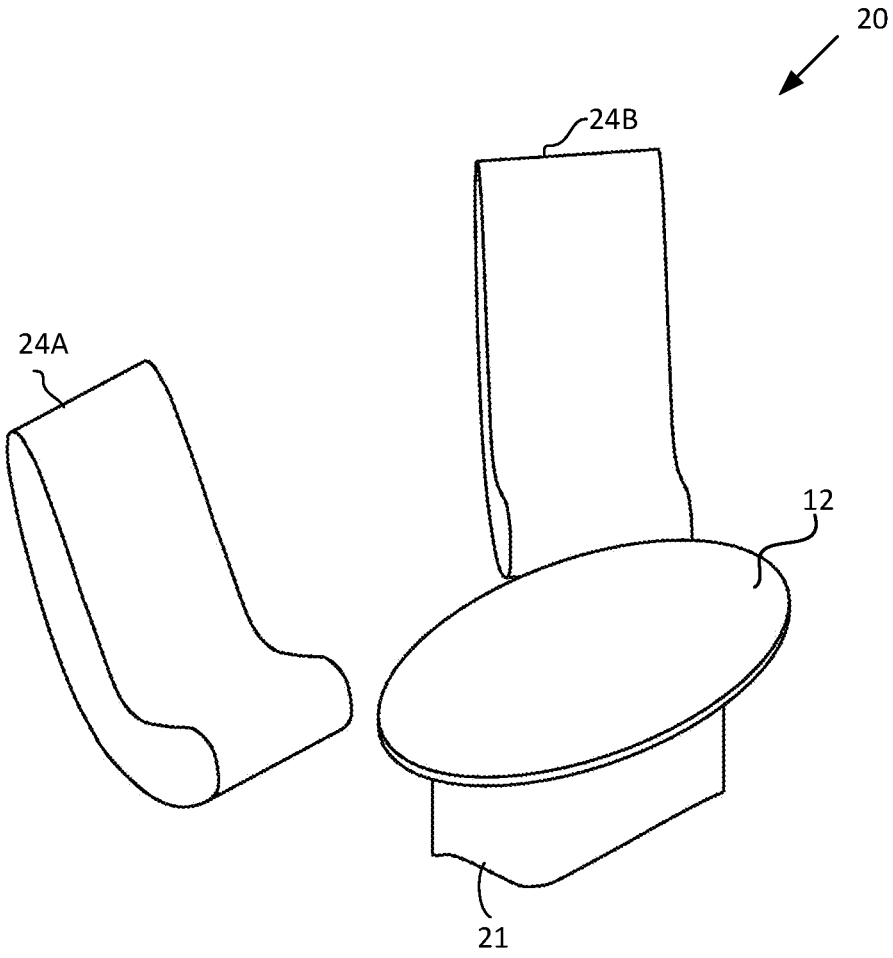
FIG. 5 is an upper left front perspective view of another example furniture system 20, in an in-use configuration, in accordance with another embodiment of the disclosure.

Referring now to FIG. 5, an upper left front perspective view of another example furniture system 20, in an in-use configuration is shown, in accordance with another embodiment of the disclosure. Example furniture system 20 has the same geometry and functions as example furniture system 10 of FIGS. 1-4, but exemplifies the appearance of either solid molded/fabricated chairs 24A, 24B or those with an inner frame and covering, for example chairs 14A, 14B of FIGS. 1-4 may be covered with padding, and then covered with upholstery. Alternatively, chairs 24A, 24B may be molded from a plastic material, composite material, or fabricated from sheet metal or wood with a different supporting frame underneath.

Figure 6:
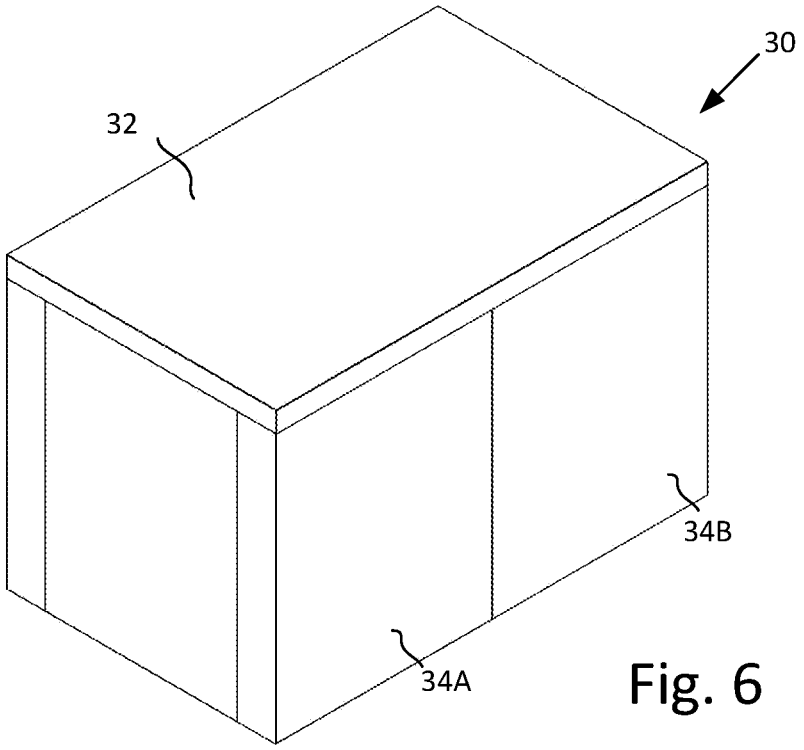
FIG. 6 is an upper left front perspective view showing an example furniture system 30 in a stowage configuration, in accordance with another embodiment of the disclosure.
Figure 7:
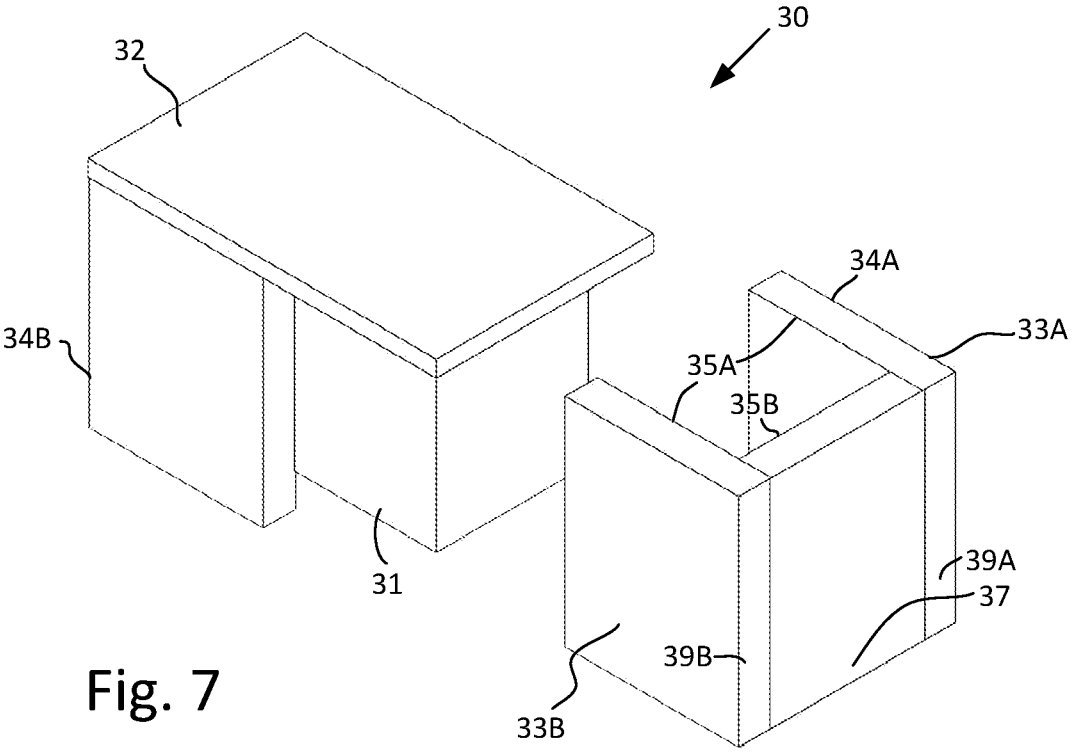
FIG. 7 is an upper right front perspective view of example furniture system 30 with one chair 34A extracted, in accordance with an embodiment of the disclosure.
Figure 8:
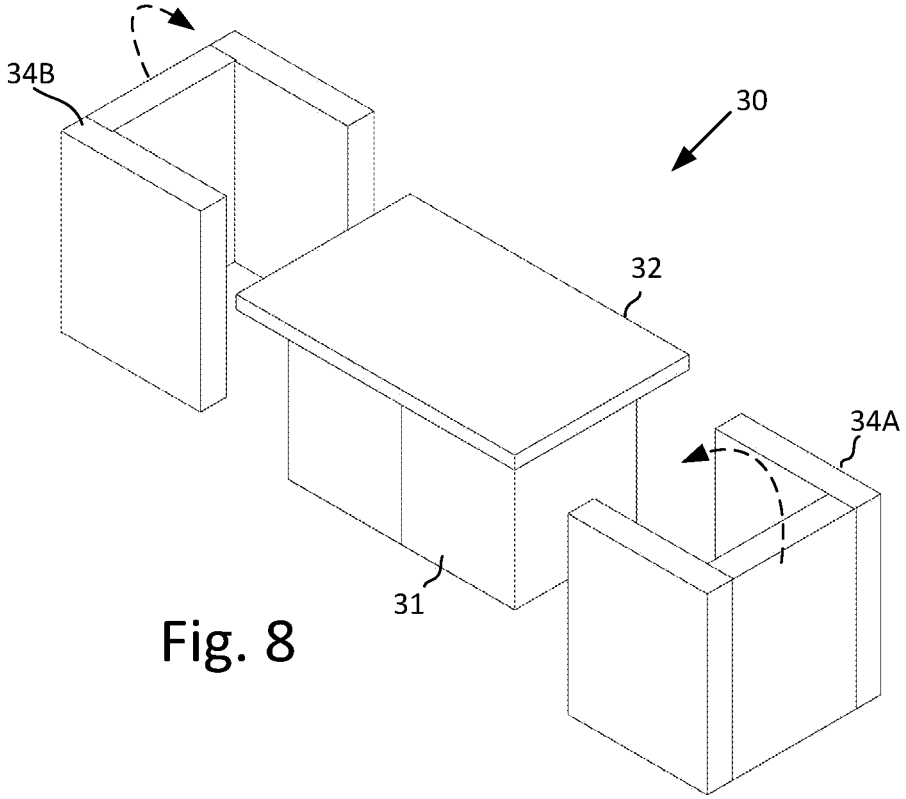
FIG. 8 is an upper right front perspective view of example furniture system 30 with both chairs 34A,34B extracted, in accordance with an embodiment of the disclosure.
Figure 9:
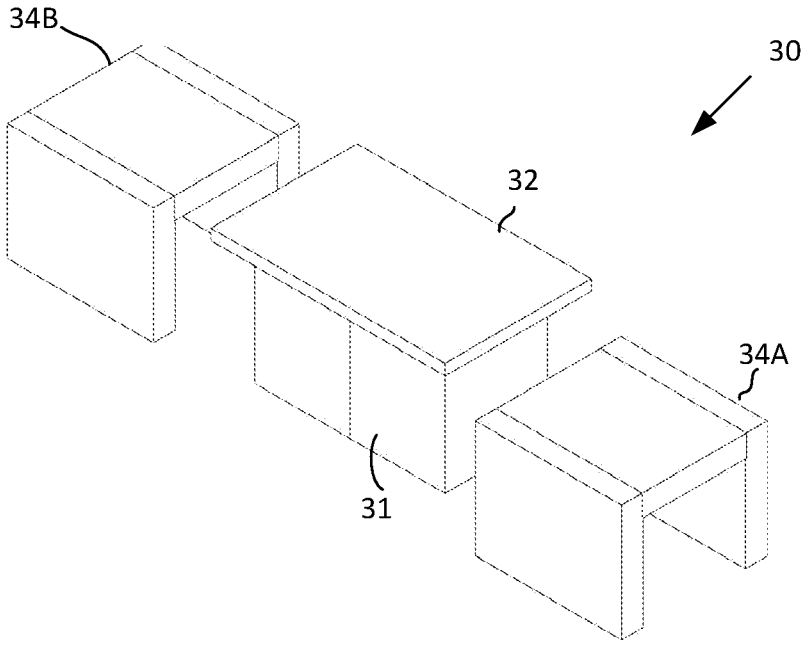
FIG. 9 is an upper right front perspective view of example furniture system 30 in a usage configuration, in accordance with an embodiment of the disclosure.

Referring now to FIG. 6, an upper left front perspective view of another example furniture system 30 is shown in a stowage configuration, in accordance with another embodiment of the disclosure. Example furniture system 30 is similar to above-described example furniture systems 10 and 20, in use and operation, except that example furniture system 30 includes chairs 34A, 34B that have rectilinear bodies, and a table base 31 that has rectilinear features to match and accept the bottom inner surfaces of chairs 34A, 34B, rather than the seating surfaces, as will be described in further detail below. Referring now to FIG. 7, an upper right front perspective view of example furniture system 30 with one chair 34A extracted is shown, in accordance with an embodiment of the disclosure. Rather than a seating surface of chairs 34A, 34B mating with table base 31, the bottom inner surface 35B formed by the underside surface of a top portion 37 of chairs 34A, 34B, and the inner surfaces 35A of lateral side portions 39A, 39B that support top portion 37, that make contact with, and wrap around table base 31. Therefore, when rotating chairs 34A, 34B to their perpendicular stowage orientation, rather than the lateral side faces of chairs 34A, 34B forming the top and bottom surfaces of chairs 34A, 34B that contact the floor and that align along the underside of a table top 32 fitted to table base, a front side 33A and a rear side 33B of chairs 34A, 34B in their seating orientation, are rotated to those positions. Referring now to FIG. 8, an upper right front perspective view of example furniture system 30 is shown, with both chairs 34A,34B extracted in preparation for rotation of chairs 34A,34B to their in-use position, as indicated by the dashed arrows. FIG. 9 shows an upper right front perspective view of example furniture system 30 in a usage configuration, in accordance with an embodiment of the disclosure. Chairs 34A,34B are rotated to their in-use orientation, with a top surface of top portion 37 providing the seating surface.

Figure 10:
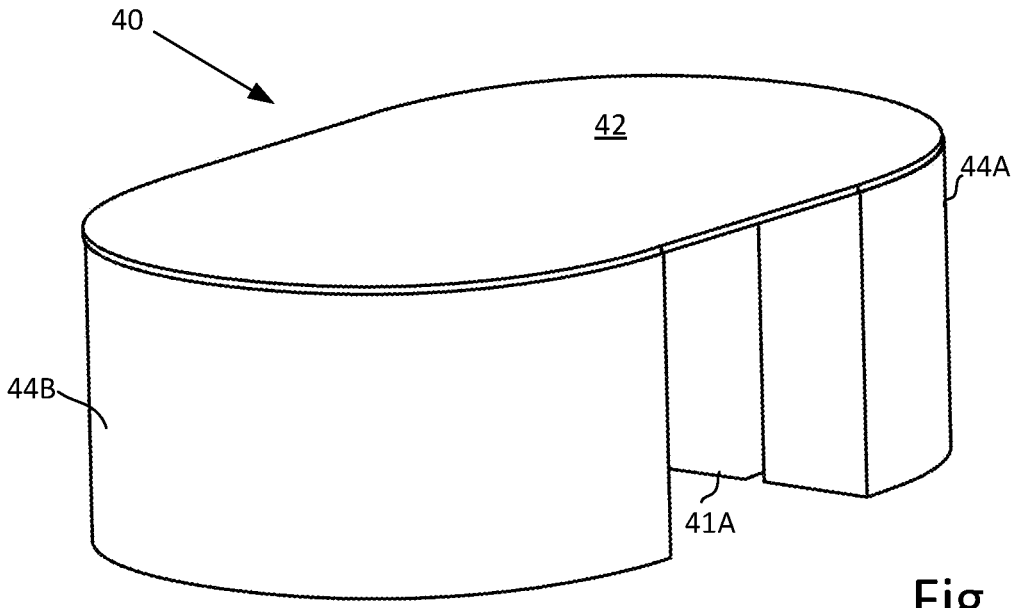
FIG. 10 is an upper left front perspective view of another example furniture system 40, in a stowage configuration, in accordance with another embodiment of the disclosure.
Figure 11:
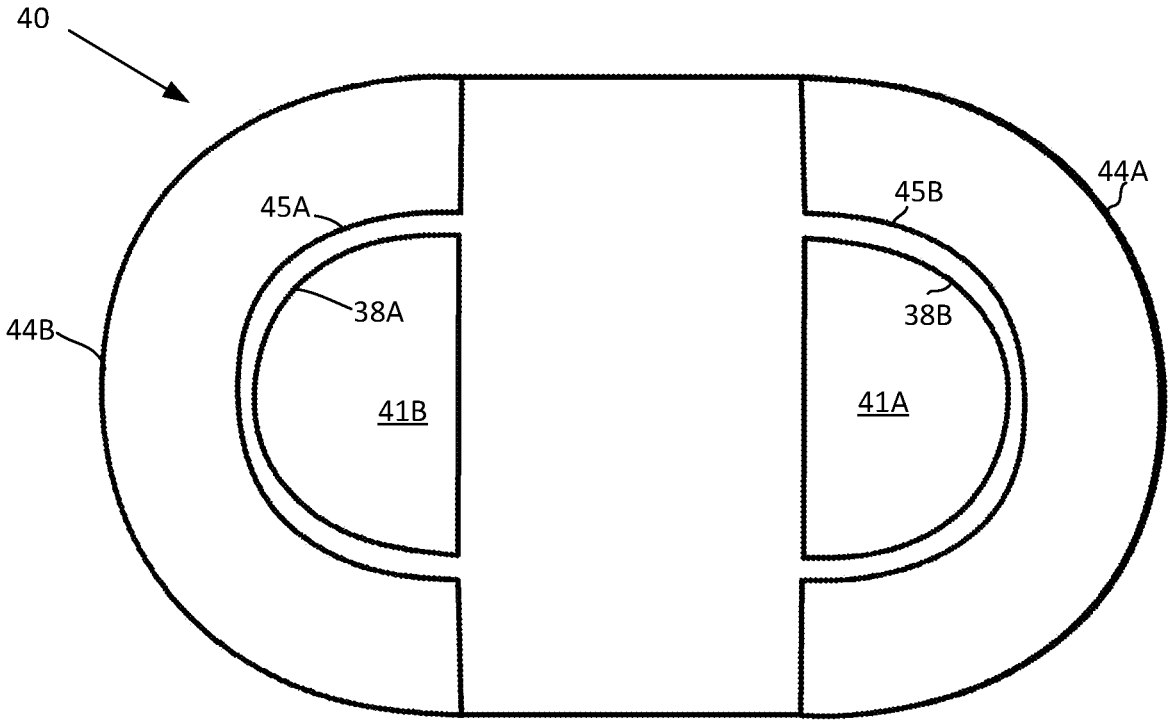
FIG. 11 is a bottom view of example furniture system 40 in the stowage configuration, in accordance with an embodiment of the disclosure.
Figure 12:
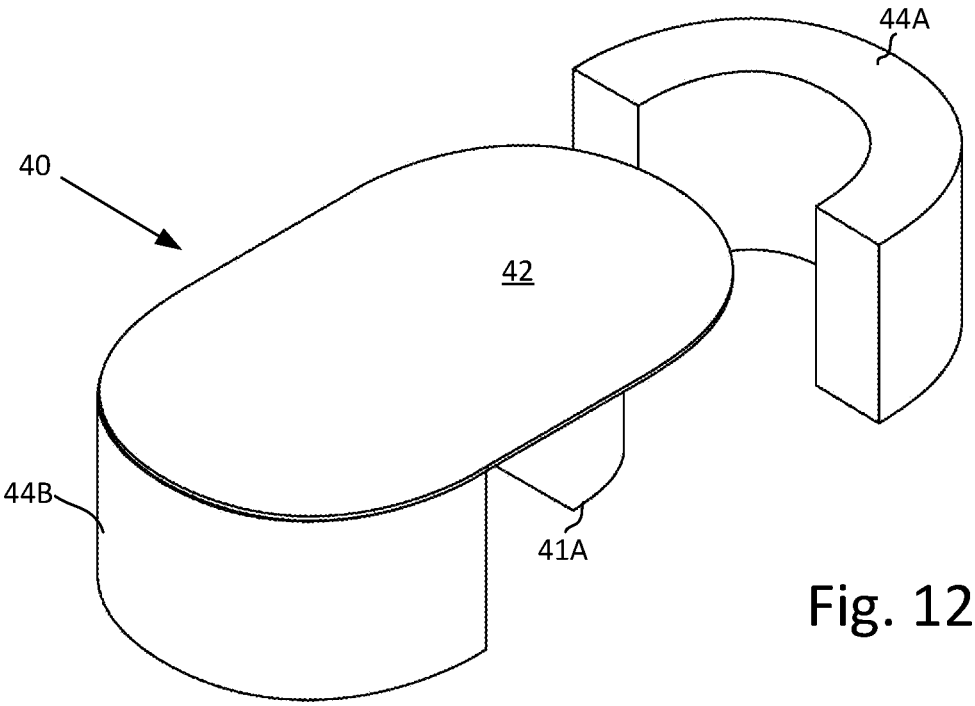
FIG. 12 is an upper left front perspective view of example furniture system 40 with one chair 44A extracted, in accordance with an embodiment of the disclosure.
Figure 13:
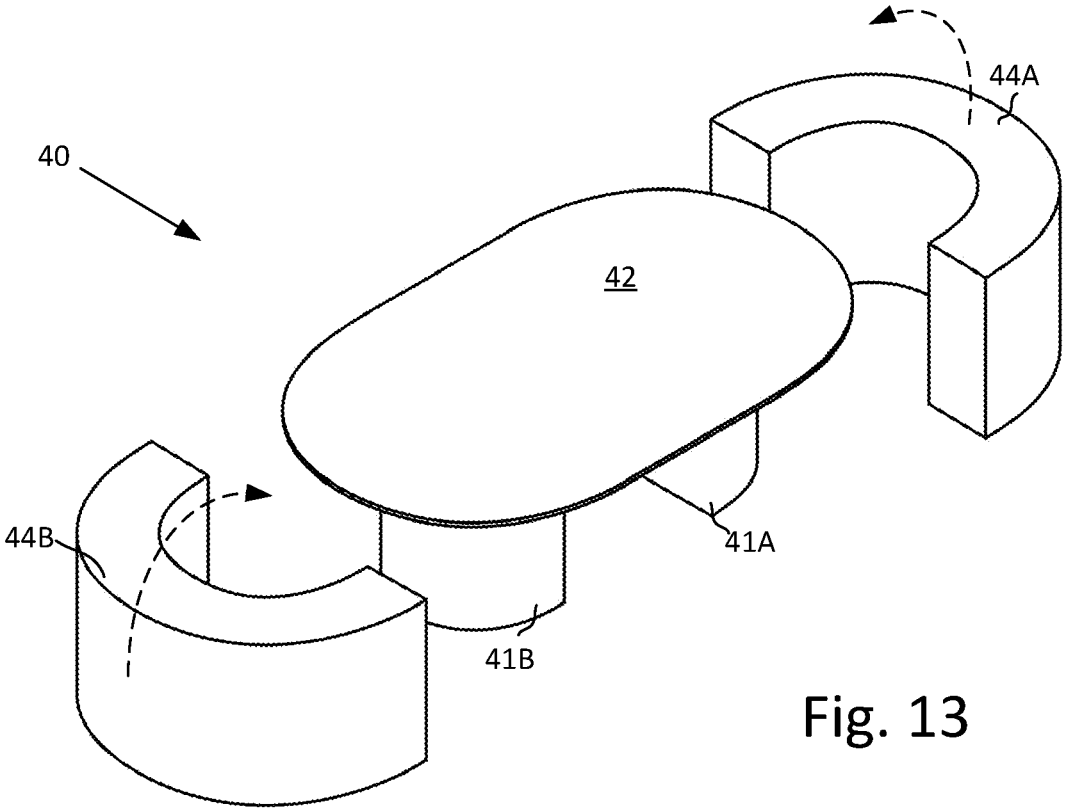
FIG. 13 is an upper right front perspective view of example furniture system 30 with both chairs 44A,44B extracted, in accordance with an embodiment of the disclosure.
Figure 14:
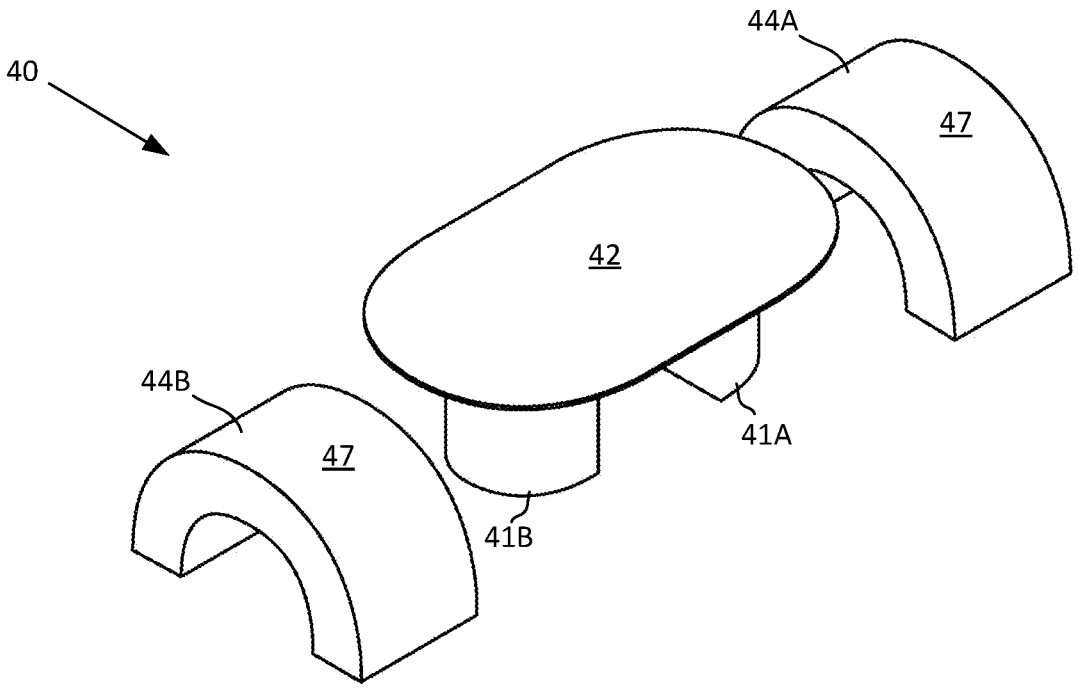
FIG. 14 is an upper left front perspective view of example furniture system 40 in a usage configuration, in accordance with an embodiment of the disclosure.

Referring now to FIG. 10, an upper left front perspective view of another example furniture system 40 is shown in a stowage configuration, in accordance with another embodiment of the disclosure. Example furniture system 40 is similar to above-described example furniture system 30, in use and operation, except that example furniture system 40 includes chairs 44A, 44B that have bodies in the form of an arch. The table base is provided by a pair of columns 41A, 41B that have curved outer profiles 38A, 38B that match and accept the (singular) bottom inner surfaces 45A, 45B of chairs 44A, 44B, as illustrated in FIG. 11, which is a bottom view of example furniture system 40 in the stowage configuration, in accordance with an embodiment of the disclosure. More than two columns may be used, in accordance with other embodiments of the disclosure, depending on the number of chairs included, and based upon desired appearance. FIG. 12 shows an upper left front perspective view of example furniture system 40 with one chair 44A extracted, and FIG. 13 shows an upper right front perspective view of example furniture system 40 with both chairs 44A,44B extracted, in accordance with an embodiment of the disclosure. FIG. 14 shows an upper left front perspective view of example furniture system 40 in a usage configuration, in accordance with an embodiment of the disclosure. Chairs 44A,44B are rotated to their in-use orientation, as indicated by the dashed arrows in FIG. 13, with an outer surface 47 of 44A,44B providing the seating surfaces.

In summary, this disclosure shows and describes example furniture systems, that provide an unobtrusive and aesthetically pleasing stowage configuration that may remain in-place. The furniture systems include a table having a table top having a substantially planar top surface, a support base that supports the table top above a floor, and one or more chairs. Each of the chairs may have a top seating surface on a top of the chair when the chair is in a seating orientation, and may have side surfaces oriented in a direction perpendicular to the top seating surface. The side surfaces may define a spacing therebetween such that when the chair is rotated to a stowage orientation, the side surfaces form a top and bottom of the rotated chair and may align with an underside of the table top and the floor to visually close a space between the underside of the table top and the floor when the one or more chairs is moved underneath the table top.

In some example embodiments, the side surfaces of the one or more chairs may be configured to conform to a corresponding one or more portions of an outer edge of the table top by a bottom surface opposite the top seating surface of the one or more chairs that defines outer edges of the side surfaces when the one or more chairs are inserted under the table top, so that the appearance of an outer surface of the chairs and the outer edge of the table top may be substantially continuous. In some example embodiments, an outer surface of the support base may be shaped to conform to the top seating surface of the one or more chairs, whereby insertion of the one or more chairs underneath the table top may be stopped and aligned by contact of the top seating surface with the outer surface of the support base. In some example embodiments, one or more chairs may be a pair of chairs, that when inserted under the table top and aligned with the outer surface of the support base, may hide the support base from view, to provide a substantially continuous surface around the bottom surfaces of the pair of chairs below the outer edge of the table top. In some example embodiments, the support base may include multiple columns, and an outer surface of each of the columns may be shaped to conform to the top seating surface of a corresponding one of the one or more chairs, so that insertion of the one or more chairs underneath the table top may be stopped and aligned by contact of the top seating surface with the outer surface of the corresponding one of the columns.

In some example embodiments, the one or more chairs may be formed by a pair of planar side supports defining a shape of the top seating surface and the bottom surface of the chairs, and multiple slats attached between the planar side supports providing the top seating surface and the bottom surface of the chairs, so that a length of the plurality of slats may define the spacing between the side surfaces of the chairs. In some example embodiments, an outer surface of the support base may be shaped to conform to the top seating surface of the one or more chairs, so that insertion of the one or more chairs underneath the table top may be stopped and aligned by contact of the top seating surface with the outer surface of the support base, and the support base may include a table top support defining a shape of the support base, a planar bottom support having a shape conformed to the shape of the support base, and multiple slats attached between the table top support and the planar bottom support, and a length of the slats may define a height of the support base. In other example embodiments, the support base may be shaped to conform to a bottom inner surface of a corresponding one of the one or more chairs, whereby insertion of the one or more chairs underneath the table top is stopped and aligned by contact of the bottom inner surface with the outer surface of the corresponding one of the columns. In some example embodiments, the one or more chairs may include an inner frame defining a shape of the one or more chairs and a covering wrapped around and fastened to the inner frame, the covering comprising one or more of leather, vinyl, polymers, plaster plastic, metal, or fabric. In other embodiments, the one or more chairs may be a molded or machined body contoured to define a shape of the one or more chairs. In some example embodiments, the molded or machined body may be fabricated from wood, a wood composite, plastic, plaster, concrete, cement, fiberglass, or metal.

While the disclosure has shown and described particular embodiments of the techniques disclosed herein, it will be understood by those skilled in the art that the foregoing and other changes in form, and details may be made therein without departing from the spirit and scope of the disclosure. For example, the design concepts shown above may be applied to other types of furniture combinations.

What is claimed is:

1. A furniture system, comprising:

a table having a table top having a substantially planar top surface and a support base that supports the table top above a floor; and one or more chairs, each of said chairs having a top seating surface on a top of the chair when the chair is in a seating orientation, and side surfaces oriented in a direction perpendicular to the top seating surface, wherein the side surfaces define a spacing therebetween such that when the chair is rotated to a stowage orientation, the side surfaces form a top and bottom of the rotated chair and align with an underside of the table top and the floor to visually close a space between the underside of the table top and the floor when the one or more chairs is moved underneath the table top, and wherein an outer surface of the support base is shaped to conform to the top seating surface of the one or more chairs, whereby insertion of the one or more chairs underneath the table top is stopped and aligned by contact of the top seating surface with the outer surface of the support base.

2. The furniture system of claim 1, wherein the side surfaces of the one or more chairs are configured to conform to a corresponding one or more portions of an outer edge of the table top by a bottom surface opposite the top seating surface of the one or more chairs that defines outer edges of the side surfaces when the one or more chairs are inserted under the table top, so that the appearance of an outer surface of the chairs and the outer edge of the table top is substantially continuous.

3. The furniture system of claim 1, wherein the one or more chairs comprises a pair of chairs, that when inserted under the table top and aligned with the outer surface of the support base, hides the support base from view, to provide a substantially continuous surface around the bottom surfaces of the pair of chairs below the outer edge of the table top.

4. The furniture system of claim 1, wherein the one or more chairs comprises a molded or machined body contoured to define a shape of the one or more chairs.

5. The furniture system of claim 4, wherein the molded or machined body is fabricated from wood, a wood composite, plastic, plaster, concrete, cement, fiberglass or metal.

6. The furniture system of claim 1, wherein the support base is shaped to conform to a bottom inner surface of a corresponding one of the one or more chairs, whereby insertion of the one or more chairs underneath the table top is stopped and aligned by contact of the bottom inner surface with the outer surface of the support base.

7. The furniture system of claim 6, wherein the support base comprises multiple columns, and wherein an outer surface of each of the columns is shaped to conform to a bottom inner surface of a corresponding one of the one or more chairs, whereby insertion of the one or more chairs underneath the table top is stopped and aligned by contact of the bottom inner surface with the outer surface of the corresponding one of the columns.

8. A method of providing seating and a working surface from a unitary stowed assembly, the method comprising:

moving one or more chairs from underneath a table having a table top having a substantially planar top surface and a support base that supports the table top above a floor; and rotating the one or more chairs to a seating orientation from a stowage orientation, each of said chairs having a top seating surface on a top of the chair when the chair is in the seating orientation, and side surfaces oriented in a direction perpendicular to the top seating surface, wherein the side surfaces define a spacing therebetween such that when the chair is rotated to the stowage orientation, the side surfaces form a top and bottom of the rotated chair and align with an underside of the table top and the floor to visually close a space between the underside of the table top and the floor when the one or more chairs is moved underneath the table top, and wherein an outer surface of the support base is shaped to conform to the top seating surface of the one or more chairs, and wherein the method further comprises storing the one or more chairs by inserting the one or more chairs underneath the table top, wherein the inserting is stopped by and aligned by contact of the top seating surface with the outer surface of the support base.

9. The method of claim 8, wherein the side surfaces of the one or more chairs are configured to conform to a corresponding one or more portions of an outer edge of the table top by a bottom surface opposite the top seating surface of the one or more chairs that defines outer edges of the side surfaces when the one or more chairs are inserted under the table top, so that the appearance of an outer surface of the chairs and the outer edge of the table top is substantially continuous.

10. The method of claim 8, wherein the one or more chairs comprises a pair of chairs, wherein the inserting the one or more chairs under the table top hides the support base from view, to provide a substantially continuous surface around the bottom surfaces of the pair of chairs below the outer edge of the table top.

11. The method of claim 8, wherein the support base comprises multiple columns, and wherein an outer surface of each of the columns is shaped to conform to the top seating surface of a corresponding one of the one or more chairs, whereby the inserting of the one or more chairs underneath the table top is stopped and aligned by contact of the top seating surface with the outer surface of the corresponding one of the columns.

12. The method of claim 8, wherein the support base is shaped to conform to a bottom inner surface of a corresponding one of the one or more chairs, whereby insertion of the one or more chairs underneath the table top is stopped and aligned by contact of the bottom inner surface with the outer surface of the support base.

13. The method of claim 8, wherein the one or more chairs comprises a molded or machined body contoured to define a shape of the one or more chairs.

14. The method of claim 13 wherein the molded or machined body is fabricated from wood, a wood composite, plastic, plaster, concrete, cement, fiberglass, or metal.

15. A furniture system, comprising:

a table having a table top having a substantially planar top surface and a support base that supports the table top above a floor; and one or more chairs, each of said chairs having a top seating surface on a top of the chair when the chair is in a seating orientation, and side surfaces oriented in a direction perpendicular to the top seating surface, wherein the side surfaces define a spacing therebetween such that when the chair is rotated to a stowage orientation, the side surfaces form a top and bottom of the rotated chair and align with an underside of the table top and the floor to visually close a space between the underside of the table top and the floor when the one or more chairs is moved underneath the table top, wherein the one or more chairs are formed by a pair of planar side supports defining a shape of the top seating surface and the bottom surface of the chairs, and a plurality of seating surface support members attached between the planar side supports providing the top seating surface and the bottom surface of the chairs, wherein a length of the plurality of seating surface support members defines the spacing between the side surfaces of the chairs.

16. The furniture system of claim 15, wherein an outer surface of the support base is shaped to conform to the top seating surface of the one or more chairs, whereby insertion of the one or more chairs underneath the table top is stopped and aligned by contact of the top seating surface with the outer surface of the support base, and wherein the support base comprises:

a table top support defining a shape of the support base;

a planar bottom support having a shape conformed to the shape of the support base; and a plurality of slats attached between the table top support and the planar bottom support, wherein a length of the plurality of slats defines a height of the support base.

17. The furniture system of claim 15, wherein the one or more chairs comprises:

an inner frame defining a shape of the one or more chairs; and a covering wrapped around and fastened to the inner frame, the covering comprising one or more of leather, vinyl, polymers, plastics, metal, plaster or fabric.

18. The furniture system of claim 15, wherein the plurality of seating surface support members comprises a plurality of slats.

19. A method of providing seating and a working surface from a unitary stowed assembly, the method comprising:

moving one or more chairs from underneath a table having a table top having a substantially planar top surface and a support base that supports the table top above a floor; and rotating the one or more chairs to a seating orientation from a stowage orientation, each of said chairs having a top seating surface on a top of the chair when the chair is in the seating orientation, and side surfaces oriented in a direction perpendicular to the top seating surface, wherein the side surfaces define a spacing therebetween such that when the chair is rotated to the stowage orientation, the side surfaces form a top and bottom of the rotated chair and align with an underside of the table top and the floor to visually close a space between the underside of the table top and the floor when the one or more chairs is moved underneath the table top, wherein the one or more chairs are formed by a pair of planar side supports defining a shape of the top seating surface and the bottom surface of the chairs, and a plurality of slats attached between the planar side supports providing the top seating surface and the bottom surface of the chairs, wherein a length of the plurality of seating surface support members defines the spacing between the side surfaces of the chairs.

20. The method of claim 19, wherein an outer surface of the support base is shaped to conform to the top seating surface of the one or more chairs, whereby insertion of the one or more chairs underneath the table top is stopped and aligned by contact of the top seating surface with the outer surface of the support base, and wherein the support base comprises:

a table top support defining a shape of the support base;

a planar bottom support having a shape conformed to the shape of the support base; and a plurality of slats attached between the table top support and the planar bottom support, wherein a length of the plurality of slats defines a height of the support base.

21. The method of claim 19, wherein the one or more chairs comprises:

an inner frame defining a shape of the one or more chairs; and a covering wrapped around and fastened to the inner frame, the covering comprising one or more of leather, vinyl, polymers, plaster, or fabric.

22. The method of claim 19, wherein the plurality of seating surface support members comprises a plurality of slats.

* * * * *